US011828473B2

(12) United States Patent
Garcia Jimenez et al.

(10) Patent No.: US 11,828,473 B2
(45) Date of Patent: Nov. 28, 2023

(54) COOKING SYSTEM

(71) Applicant: BSH Hausgeräte GmbH, Munich (DE)

(72) Inventors: Jose Ramon Garcia Jimenez, Saragossa (ES); Jose Andres Garcia Martinez, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 442 days.

(21) Appl. No.: 16/973,793

(22) PCT Filed: Jun. 7, 2019

(86) PCT No.: PCT/IB2019/054751
§ 371 (c)(1),
(2) Date: Dec. 10, 2020

(87) PCT Pub. No.: WO2019/243938
PCT Pub. Date: Dec. 26, 2019

(65) Prior Publication Data

US 2021/0247072 A1 Aug. 12, 2021

(30) Foreign Application Priority Data

Jun. 21, 2018 (ES) ..... ES201830624

(51) Int. Cl.
*F24C 7/08* (2006.01)
*H05B 3/74* (2006.01)
*H05B 6/06* (2006.01)

(52) U.S. Cl.
CPC ..... *F24C 7/083* (2013.01); *F24C 7/082* (2013.01); *H05B 3/746* (2013.01); *H05B 6/062* (2013.01)

(58) Field of Classification Search
CPC ..... F24C 7/083; F24C 7/082; H05B 6/062; H05B 3/746; H05B 2213/04
See application file for complete search history.

(56) References Cited

U.S. PATENT DOCUMENTS

2013/0240505 A1 9/2013 Cha
2014/0305928 A1* 10/2014 Thompson ..... H05B 3/74 219/448.12
2015/0374163 A1 12/2015 Guardigli
2017/0223781 A1 8/2017 Kim

FOREIGN PATENT DOCUMENTS

DE 102009000273 A1 7/2010
DE 102014216709 A1 3/2015
FR 2869398 A1 10/2005

OTHER PUBLICATIONS

National Search Report ES P201830624 dated May 24, 2019.
International Search Report PCT/IB2019/054751 dated Aug. 6, 2019.

* cited by examiner

*Primary Examiner* — Dana Ross
*Assistant Examiner* — Kuangyue Chen
(74) *Attorney, Agent, or Firm* — Michael E. Tschupp; Andre Pallapies; Brandon G. Braun

(57) ABSTRACT

A cooking system includes an operator interface configured to enable input of an identification characteristic for a placement unit for placement on a cooking surface for purpose of a heating operation, and a control unit configured to release or block a cooking function for the placement unit as a function of the identification characteristic input via the operator interface.

20 Claims, 2 Drawing Sheets

COOKING SYSTEM

CROSS-REFERENCES TO RELATED APPLICATIONS

This application is the U.S. National Stage of International Application No. PCT/IB2019/054751, filed Jun. 7, 2019, which designated the United States and has been published as International Publication No. WO 2019/243938 A1 and which claims the priority of Spanish Patent Application, Serial No. P201830624, filed Jun. 21, 2018, pursuant to 35 U.S.C. 119(a)-(d).

BACKGROUND OF THE INVENTION

The invention relates to a cooking system and a method for operating a cooking system.

A cooking system having an operator interface and a control unit is already known from the prior art. The control unit provides multiple cooking functions, from which an operator can select freely by means of an operating input by way of the operator interface, without having to input an identification characteristic and independently of a placement unit placed on a cooking surface.

BRIEF SUMMARY OF THE INVENTION

It is the object of the invention in particular to provide a generic system with improved properties in respect of ease of operation.

A cooking system, in particular an induction cooking system, is proposed with at least one operator interface and with at least one control unit, which releases and/or provides and/or blocks and/or denies and/or prevents at least one cooking function for the placement unit as a function of at least one identification characteristic input by way of the operator interface for at least one placement unit, which is provided for placing on at least one cooking surface for the purpose of a heating operation.

Such an embodiment in particular allows significant ease of operation to be achieved, in particular in relation to a high level of safety. By inputting the identification characteristic for a placement unit it is possible in particular to prevent the provision of a cooking function for a placement unit with a low level of safety, for example an unknown or unsuitable placement unit, thereby allowing in particular the safe performance of a cooking function. In particular it is possible to make the selection of a cooking function a function of the identification characteristic, allowing access to the cooking function to be blocked, in particular for elderly and/or forgetful people, for whom there might be a high risk of forgetting the placement unit on the cooking surface, thereby providing a high level of safety in particular.

A "cooking system" refers in particular to a system which has at least one cooktop object and/or at least one cooktop and/or at least one cooktop equipment object and which could also have in particular at least one kitchen object and/or at least one further structural unit, which is configured differently in particular from a cooktop object and/or a cooktop and/or a cooktop equipment object. A "cooktop object" refers in particular to at least a part, in particular a subassembly, of a cooktop, in particular an induction cooktop. A "cooktop equipment object" refers in particular to an object which is provided in particular for application and/or use with a cooktop and/or which is configured in particular as equipment for a cooktop. A "kitchen object" refers in particular to an object which is provided for application and/or use in a kitchen, in particular for processing and/or treating and/or storing at least one food.

For example the cooking system could have at least one cooktop object, which could be in particular a subassembly of a cooktop. At least one cooktop object could be for example at least one control unit and/or at least one operator interface and/or at least one housing unit and/or at least one heating unit and/or at least one inverter and/or at least one placement plate configured as a cooktop plate and/or at least one extractor unit and/or at least one cooktop electronics unit. As an alternative or addition, in particular to the cooktop object, the cooking system could have for example at least one cooktop and in particular, in addition to the cooktop, at least one further structural unit, for example in particular at least one placement plate configured as a countertop.

For example at least one cooktop equipment object could be a sensor unit for the external measurement of a temperature of a cookware item and/or an item to be cooked. Alternatively or additionally at least one cooktop equipment object could be for example a cookware item and/or a placement unit and/or a contact module, which could be provided in particular for arrangement on the cookware item and/or on the placement unit. Alternatively or additionally at least one cooktop equipment object could be in particular an adapter, which could be provided in particular for coupling to at least one kitchen object and in particular for standing and/or lying on the placement plate.

At least one kitchen object could be for example a food processor and/or a subassembly or a food processor, in particular a food processor container. Alternatively or additionally at least one kitchen object could be a cleaning appliance and/or a refrigeration appliance and/or at least one placement plate configured as a countertop. At least one further structural unit could be for example a mobile device and/or a computation unit, for example a computer.

An "operator interface" refers in particular to a unit, which is provided for, in particular optical and/or acoustic and/or acoustic and/or haptic, communication between an operator and the control unit. In particular the operator interface is provided for the inputting and/or selecting of at least one operating parameter. At least one operating parameter could be for example a heating power and/or a heating power density and/or a heating zone. Alternatively or additionally the operator interface could be provided in particular for the outputting of at least one value of at least one operating parameter to an operator.

A "control unit" refers in particular to an electronic unit, which controls and/or regulates at least one cooking function and/or at least one main cooking function, in particular the heating operation for at least one placement unit, in at least one operating state. The control unit in particular has at least one computation unit and in particular, in addition to the computation unit, at least one storage unit, in which in particular at least one control and/or regulation program is stored, which is provided in particular for execution by the computation unit. In particular the control unit is provided to control and/or regulate at least one, in particular electrical and/or electronic, cooktop object that is different from the control unit.

An "identification characteristic" refers in particular to a characteristic which is provided to identify at least one person and/or at least one placement unit and which is in particular characteristic of the person and/or the placement unit. The person could be for example an operator and/or a customer. A first identification characteristic, which is provided in particular to recognize and/or identify at least one first person and/or at least one first placement unit, differs in particular in at least one characteristic property from a second identification characteristic, which is provided in particular to recognize and/or identify at least one second person and/or at least one second placement unit. The characteristic property could be for example a number and/or a figure and/or a punctuation mark and/or an optical symbol, for example a fingerprint and/or facial recognition, and/or an acoustic signal, for example a voice and/or a sound and/or a tone and/or a sound sequence and/or a tone sequence.

A "placement unit" refers in particular to a unit which is provided to stand and/or lie on a placement plate, in particular for the purpose of a heating operation for at least part of the placement unit. The placement unit could be for example at least one cookware element and/or at least one cookware item. Alternatively or additionally the placement unit could have at least one support unit, which could be provided in particular for the placement of at least one cookware element, in particular the cookware element, and/or at least one cookware item, in particular the cookware item. The support unit could be provided in at least one operating state for example to be arranged between a cookware element and/or cookware item of the placement unit to be heated and the placement plate. In particular at least one object of the placement unit, in particular multiple objects of the placement unit and advantageously all the objects of the placement unit, could be integrated at least partially and advantageously at least largely in the support unit.

As an alternative, in particular to the embodiment in which the placement unit has at least one support unit and in particular at least one cookware element and/or at least one cookware item, the placement unit could have for example at least one housing unit, which could be configured in particular as a placement outer housing unit and could in particular at least largely form an outer housing of the placement unit. In particular at least one object of the placement unit, in particular multiple objects of the placement unit and advantageously all the objects of the placement unit, could be integrated at least partially and advantageously at least largely in the housing unit.

At least one object of the placement unit could be for example a placement operator interface and/or a placement control unit and/or a placement sensor unit and/or a placement transmit unit. "At least largely" refers in particular to a portion, in particular a portion by mass and/or a portion by volume, of at least 70%, in particular at least 80%, advantageously at least 90% and preferably at least 95%.

In particular the cooking system has at least one placement plate. The placement plate is provided in particular for the vertical and/or horizontal placement of at least one placement unit and/or the horizontal placement of at least one item to be cooked. A "placement plate" refers in particular to at least one plate-type unit which is provided for the vertical placement of at least one placement unit and/or the horizontal placement of at least one placement unit and/or the vertical placement of at least one cookware item and/or the horizontal placement of at least one item to be cooked for the purpose of a heating operation. The placement plate could be configured for example as a partial region of at least one countertop, in particular at least one kitchen countertop, in particular of the cooking system. Alternatively or additionally the placement plate could be configured as a cooktop plate. The placement plate configured as a cooktop plate could form in particular at least part of a cooktop outer housing and, in particular together with at least one cooktop housing unit configured in particular as an outer housing unit, to which the placement plate configured as a cooktop plate could in particular be connected in at least one mounted state, could at least largely form at least one cooktop outer housing. The placement plate could be formed for example at least largely of glass and/or glass ceramic and/or neolith and/or Dekton and/or wood and/or marble and/or stone, in particular natural stone, and/or laminate and/or metal and/or plastic and/or ceramic.

The placement plate defines and/or delimits at least one cooking surface, which is provided in particular for the vertical placement of at least one placement unit and/or the horizontal placement of at least one placement unit and/or the vertical placement of at least one cookware item and/or at the horizontal placement of least one item to be cooked for the purpose of the heating operation. In particular the cooking surface is configured as a partial surface region of the placement plate, below which at least one heating unit is arranged in an installed position. In particular the cooking system comprises the heating unit, which is configured in particular as an induction heating unit.

The expression that the control unit releases and/or blocks at least one cooking function for the placement unit as a function of at least one identification characteristic "for at least one placement unit" means in particular that the control unit releases and/or blocks the cooking function for in particular just one placement unit and/or for at least two, in particular at least three, advantageously at least four, particularly advantageously at least five, preferably at least six and particularly preferably all the placement units, which are in particular placed on the cooking surface, as a function of the identification characteristic.

In particular the identification characteristic could be provided for in particular just one placement unit and/or be assigned in particular to just one placement unit. Alternatively or additionally the identification characteristic could be provided for at least two, in particular at least three, advantageously at least four, particularly advantageously at least five, preferably at least six and particularly preferably all the placement units, which are in particular placed on the cooking surface, and/or be assigned to said placement units.

A "cooking function" refers in particular to a function which at least partially defines at least one boiling process and/or at least one cooking process and/or which is at least partially integrated in at least one boiling process and/or at least one cooking process and/or which is provided to assist at least one boiling process and/or at least one cooking process.

For example, at least one cooking function could be a heating function and/or an operating state, in particular a normal operating state and/or a safe operating state. Alternatively or additionally at least one cooking function could also be in particular a sensor function. In the case of at least one cooking function that is a sensor function, the control unit could release and/or block at least one temperature sensor and/or at least one acceleration sensor and/or at least one motion sensor and/or at least one weight sensor and/or at least one sensor for detecting at least one electrical characteristic. The electrical characteristic could be for example an electric current and/or an electric voltage and/or an inductivity and/or a capacitance. Alternatively or additionally at least one cooking function could be in particular an in particular automatic boiling program and/or an in particular automatic cooking program. Alternatively or additionally at least one cooking function could be in particular a type of boiling and/or a type of cooking and/or a type of heating operation.

The expression that the control unit releases and/or blocks at least one action "as a function of at least one characteristic" means in particular that the control unit compares the characteristic with at least one reference characteristic for the characteristic, which can be stored and/or is stored in particular in the storage unit of the control unit, and releases the action in particular if the characteristic corresponds at least largely and advantageously completely to the reference characteristic for the characteristic and blocks the action in particular if the characteristic differs in at least one feature and/or in at least one property from the reference characteristic for the characteristic.

The characteristic could be for example the identification characteristic and/or at least one placement unit characteristic. The action could be for example a heating operation and/or a cooking function. "Release" here means in particular provide and/or offer, in particular for selection, and/or perform, in particular automatically. "Block" means in particular deny and/or prevent and/or conceal execution and/or selection.

The control unit in particular compares the input identification characteristic with at least one reference characteristic for the identification characteristic. In particular the control unit has at least one storage unit, in which at least one reference characteristic for the identification characteristic can be stored and/or is stored. At least one reference characteristic for the identification characteristic could be stored, for example predefined, in the storage unit. Alternatively or additionally at least one reference characteristic for the identification characteristic could be stored in particular manually in the storage unit. The control unit could be provided in particular to receive at least one reference characteristic for the identification characteristic, in particular from at least one further unit, for the purpose of storing the received reference characteristic for the identification characteristic in the storage unit.

The control unit releases the cooking function in particular if the input identification characteristic corresponds at least largely and advantageously completely to at least one reference variable for the identification characteristic.

The control unit blocks the cooking function in particular if the input identification characteristic differs at least partially from at least one reference variable for the identification characteristic. In particular the control unit blocks the cooking function if the input identification characteristic differs in at least one feature and/or in at least one property from at least one reference variable for the identification characteristic.

The cooking system in particular has at least one output unit, which is provided in particular to output at least one operating parameter. The output unit could be configured separately from the operator interface for example. The output unit is advantageously configured at least partially as a single piece with the operator interface and is in particular integrated at least partially in the operator interface. In particular the control unit controls and/or regulates the output unit in at least one operating state.

"Provided" in particular means specifically programmed, designed and/or equipped. That an object is provided for a specific function means in particular that the object complies with and/or performs said specific function in at least one application and/or operating state.

It is also proposed that the cooking system has at least one detection unit, which is provided to detect at least one placement unit characteristic of the placement unit, as a function of which the control unit releases and/or blocks a heating operation for the placement unit. A "detection unit" refers in particular to a unit which is provided to detect and/or receive the placement unit characteristic. In particular the detection unit could have at least one sensor unit, which could be provided to detect the placement unit characteristic. A "sensor unit" refers in particular to a unit which has at least one detector for detecting at least one sensor characteristic and which is provided in particular to output at least one value characterizing the sensor characteristic, the sensor characteristic advantageously being a physical and/or chemical variable. The sensor unit could be provided for example to detect the placement unit characteristic inductively and/or capacitively. Alternatively or additionally the sensor unit could be provided for example to detect the placement unit characteristic by means of at least one camera and/or by means of electromagnetic radiation and/or by means of inductive coupling and/or by means of capacitive coupling and/or by means of an electric current and/or by means of an electric voltage. In particular the sensor characteristic characterizes the placement unit characteristic. The control unit determines at least one placement unit characteristic as a function of the sensor characteristic in particular in at least one operating state. In particular the detection unit could have at least one receive unit, which could be provided to receive the placement unit characteristic. In particular the receive unit could be provided to receive the placement unit characteristic from the operator interface and/or at least one further unit and/or at least one mobile device and/or at least one network. The further unit is in particular an external unit, which is configured and/or arranged in particular differently from the placement unit. In particular the further unit could be integrated in at least one cooktop and/or in at least one mobile device. Alternatively or additionally the further unit could be part of a network. The mobile device could be for example a cellphone and/or a tablet and/or a laptop and/or a mobile phone. The network could be for example a household network and/or a global network and/or a regional network and/or a network within a building. A "placement unit characteristic" of a placement unit refers in particular to a characteristic which characterizes the placement unit and/or which is assigned to the placement unit. In particular the placement unit characteristic differs from a characteristic which is in particular a function of at least one operating state and/or at least one placement position. The placement unit characteristic differs in particular from a temperature and/or a cooking state and/or a placement position and/or a number of heating units heating the placement unit and/or a heating zone. For example, at least one placement unit characteristic could be a geometric characteristic. The geometric characteristic could be for example a shape and/or a configuration and/or a height and/or a diameter and/or a weight. Alternatively or additionally at least one placement unit characteristic could be a suitability characteristic. The suitability characteristic could be for example a material, in particular of a surface of the placement unit to be heated and/or a type and/or a color, in particular of a surface of the placement unit to be heated. A suitability characteristic which is a type could be for example a pot and/or a pan and/or a steam cooking appliance and/or a wok and/or a teppanyaki plate and/or a toaster and/or a grill. This in particular allows a high level of safety to be achieved as a specific placement unit in particular can only be heated in the event of a specific and/or appropriate and/or suitable placement unit characteristic.

It is also proposed that the control unit has at least one storage unit, in which at least one reference characteristic for the placement unit characteristic is stored in at least one operating state and at least one identity is assigned to the placement unit by comparing the reference characteristic with the detected placement unit characteristic. At least one reference characteristic could be stored, for example predefined, in the storage unit. Alternatively or additionally at least one reference characteristic could be able to be stored in particular manually in the storage unit, in particular in at least one further operating state, which is before and/or precedes the operating state in particular in time. In at least one operating state the control unit in particular compares the reference characteristic with the detected placement unit characteristic of the placement unit. If the detected placement unit characteristic of the placement unit corresponds to at least one reference characteristic for the placement unit characteristic, the control unit assigns an identity to the placement unit and/or identifies the placement unit. A "reference characteristic" refers in particular to a characteristic which defines and/or forms a reference object, by means of which at least one identity can be assigned to a placed placement unit. The identity could be known and/or unknown for example. Alternatively or additionally the identity could have at least one placement unit characteristic, for example a geometric characteristic and/or a suitability characteristic. This in particular allows identification of the placement unit, in particular allowing a tailored and/or optimal heating operation for the placement unit.

At least one cooking function could in particular be a sensor function, with which the control unit detects at least one sensor characteristic, in particular by means of at least one temperature sensor and/or at least one acceleration sensor and/or at least one motion sensor and/or at least one weight sensor and/or at least one sensor for detecting at least one electrical characteristic and heats the placement unit in particular as a function of the sensor characteristic. At least one cooking function is preferably a safe operating state, in which the control unit releases a heating operation for at least one known placement unit and blocks a heating operation for at least one unknown placement unit. In particular the control unit considers and/or identifies a placement unit, to which at least one identity can be assigned, as a known placement unit. A known placement unit in particular has at least one known placement unit characteristic and advantageously at least two, particularly advantageously at least four, preferably at least eight and particularly preferably only known placement unit characteristics. The control unit considers and/or identifies a placement unit, for which identity assignment fails and/or is not possible, as an unknown placement unit. An unknown placement unit in particular has at least one unknown placement unit characteristic and could in particular have at least one further unknown placement unit characteristic. A "safe operating state" refers in particular to an operating state in which the control unit blocks at least one heating operation and/or at least one cooking function that is different from an operating state in particular for at least one placement unit. This in particular allows a high level of safety to be achieved and/or an optimal cooking result, in particular for a known placement unit, as the known placement unit can in particular be heated optimally. By blocking a heating operation for unknown placement units and in particular only heating known placement units, it is possible in particular to reduce the risk of boiling over and/or overheating.

For example, at least one cooking function that is a normal operating state could be preset and inputting of the identification characteristic could be necessary in particular to release the cooking function that is a safe operating state. The safe cooking mode, in particular the cooking function that is a safe operating state, is preferably preset. A "preset" function refers in particular to a function that has been programmed and/or set in the factory and is provided in particular for preferred execution and is automatically activated and/or selected and/or called up and/or executed in particular at start-up, in particular of a cooktop. This results in particular in a high level of safety for an operator and/or specific suitability for elderly and/or forgetful people, for whom in particular there might be a high risk of forgetting the placement unit on the cooking surface and/or forgetting the identification characteristic.

It is also proposed that at least one cooking function is a normal operating state, in which the control unit releases a heating operation for the placement unit regardless of the placement unit characteristic. A "normal operating state" refers in particular to an operating state in which the control unit in particular releases a heating operation and/or at least one cooking function that is different from an operating state regardless of an identity of at least one placement unit. This in particular allows a high level of flexibility to be achieved, as a plurality of placement units in particular can be heated and/or a plurality of cooking functions that are different from an operating state can be selected.

In particular the control unit switches between safe operating state and normal operating state as a function of the input identification characteristic, thereby allowing significant ease of operation and/or simple and/or intuitive operation.

It is also proposed that the control unit monitors an in particular manual heating operation for the placement unit in at least one cooking function, in particular in the cooking function configured as a safe operating state, and initiates at least one safety action to avoid overheating in the event of in particular imminent overheating. In particular the cooking system has at least one sensor unit, which is provided in particular to detect at least one sensor characteristic, which in particular identifies and/or characterizes and/or forms and/or defines at least one operating parameter. The operating parameter could be for example a temperature and/or a weight and/or a cooking state and/or a boiling state. For example, the cooking state and/or boiling state could be simmering and/or poaching and/or boiling over and/or boiling and/or gentle boiling. The sensor unit is provided in particular to detect an in particular imminent overheating by means of at least one temperature measurement and/or by means of at least one measurement of an acceleration characteristic and forward it in particular to the control unit. This in particular ensures a high level of safety and/or prevents boiling over and/or overheating, in particular for elderly and/or forgetful people, for whom in particular there might be a high risk of forgetting the placement unit on the cooking surface.

The safety action could be in particular outputting a warning and/or an operating prompt. The safety action is preferably the termination of the heating operation for the placement unit, in particular by deactivating at least one heating unit and advantageously at least most and particularly advantageously all the heating units heating the placement unit. This results in a safe embodiment and/or safe operation, in which it is possible in particular to avoid boiling over and/or overheating.

It is also proposed that at least one cooking function is an automatic cooking program, in which the control unit executes at least one cooking function that is different from an operating state in particular automatically and advantageously heats the placement unit automatically and in particular prepares items to be cooked that are present in the placement unit. This in particular ensures significant ease of operation. For example the control unit could have at least one timer and be provided in particular to finish cooking and/or preparing items to be cooked at an in particular manually preset time by means of the cooking function that is an automatic cooking program, with the result that an operator can eat the prepared food in particular at the preset time, even though said operator might in particular be unable to do so in a time period immediately preceding the preset time.

For example, at least one identification characteristic could be a fingerprint and/or facial recognition and/or speech recognition. At least one and in particular the identification characteristic is preferably a password that can be input in particular manually. A "password" refers in particular to a series of at least two, in particular at least three, advantageously at least five, preferably at least eight and particularly preferably multiple figures and/or letters and/or special characters and/or punctuation marks. This in particular ensures a high safety standard and/or allows a high level of flexibility. In particular a separate identification characteristic can easily be provided for each placement unit, thereby allowing a cooking function to be released specifically in particular for any placement unit.

The control unit could for example be configured at least partially as a mobile device control unit and in particular be integrated at least partially, advantageously at least largely in at least one mobile device. The control unit is preferably configured at least partially as a cooktop control unit and is in particular integrated at least partially, advantageously at least largely and particularly advantageously completely in at least one cooktop. In particular the cooktop control unit is integrated at least partially, in particular at least largely and advantageously completely in at least one control unit of a cooktop. The expression that an object is configured "at least partially" as a cooktop object means in particular that at least part of the object is configured as part of the cooktop object and in particular is integrated in the cooktop object. For example, at least a further part of the object could be configured as an appliance object that is different from a cooktop object, for example as a mobile device object. The expression that an object is "configured as a cooktop object" means in particular that the object is integrated in at least one cooktop. This means in particular that few parts are required and/or storage outlay is reduced.

The operator interface could be configured for example at least partially as a mobile device operator interface and be integrated in particular at least partially, advantageously at least largely in at least one mobile device. The operator interface is preferably configured at least partially as a cooktop operator interface and is integrated in particular at least partially, advantageously at least largely and particularly advantageously completely in at least one cooktop. The operator interface in particular has at least one output unit and advantageously at least one display unit. In particular the operator interface has at least one liquid crystal display. In particular the cooktop operator interface is integrated at least partially, in particular at least largely and advantageously completely in at least one operator interface of a cooktop. This means in particular that few parts are required and/or storage outlay is reduced.

A particularly high level of safety and/or reduced storage outlay can be achieved in particular by a cooktop, in particular an induction cooktop, with at least one control unit of an inventive cooking system, which has at least one control unit interface and is provided to communicate with the operator interface by way of the control unit interface. In particular the control unit is provided to receive at least one characteristic from the operator interface and/or to transmit at least one characteristic to the operator interface by way of the control unit interface. The cooktop could in particular comprise only the control unit and/or the operator interface of the cooking system. The cooktop could advantageously comprise in particular the entire cooking system.

Alternatively the cooking system could for example comprise at least one and in particular the cooktop, in which in particular at least one control unit and/or at least one operator interface of an inventive cooking system could be integrated at least partially, in particular at least largely and advantageously completely.

An extremely high degree of safety can be provided in particular by a method for operating an inventive cooking system, with which at least one cooking function can be released and/or blocked for the placement unit as a function of at least one identification characteristic for at least one placement unit input by way of at least one operator interface.

The cooking system here is not restricted to the application and embodiment described above. In particular the cooking system can have a number of individual elements, parts and units that is different from the number cited herein to comply with a mode of operation described herein.

BRIEF DESCRIPTION OF THE DRAWINGS

Further advantages will emerge from the description of the drawing that follows. The drawing shows exemplary embodiments of the invention. The drawing, description and claims contain numerous features in combination. The person skilled in the art will expediently also consider the features individually and bring them together in useful further combinations.

DETAILED DESCRIPTION OF EXEMPLARY EMBODIMENTS OF THE PRESENT INVENTION

Figure 1:
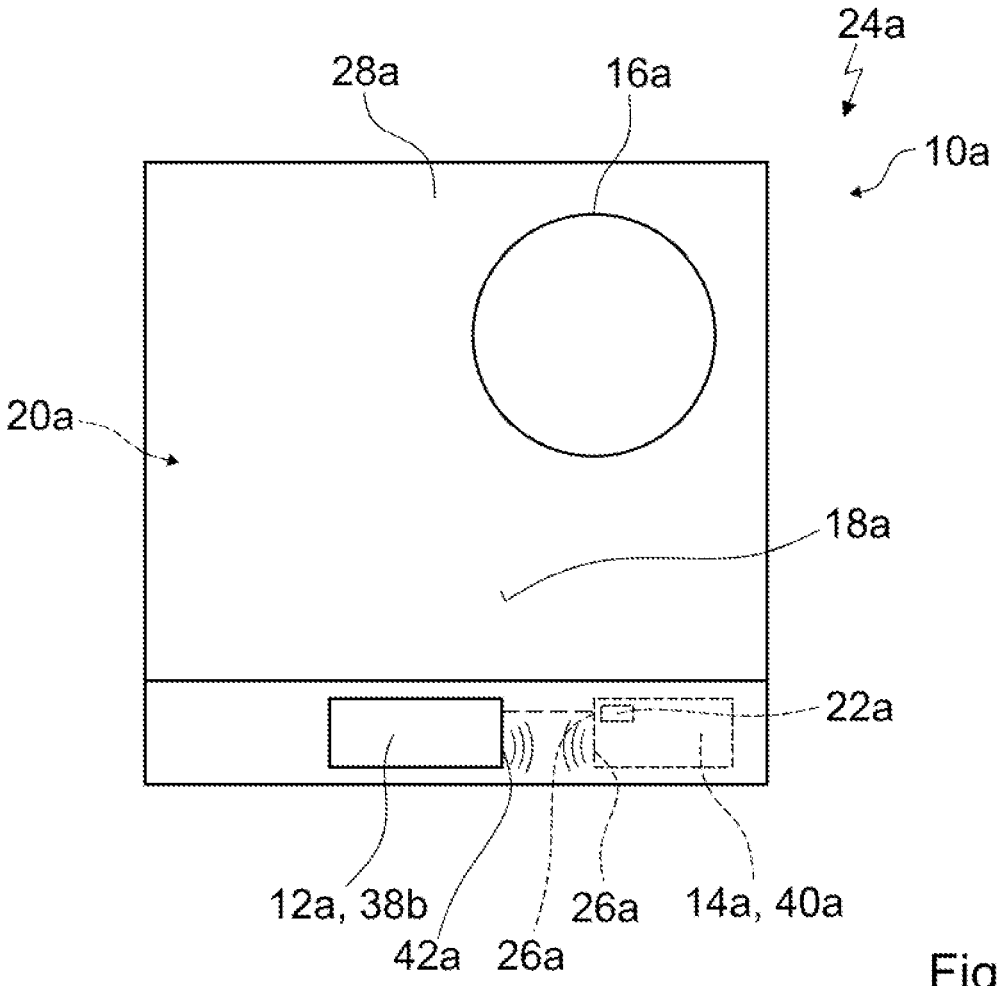
FIG. 1 shows a schematic, highly simplified top view of a cooktop with a cooking system.

FIG. 1 shows a cooktop 24*a*, which is configured as an induction cooktop, with a cooking system 10*a*, which is configured as an induction cooking system.

The cooking system 10*a* has a placement plate 28*a*. In a mounted state the placement plate 28*a* forms a visible surface, which is arranged in particular facing an operator in a mounted state. The placement plate 28*a* is provided for the placing of a placement unit 16*a* for the purpose of a heating operation for the placement unit 16*a*. In the present exemplary embodiment the placement plate 28*a* is configured as a cooktop plate.

The placement plate 28*a* defines a cooking surface 18*a*. The cooking surface 18*a* is configured as a surface of the placement plate 28*a* facing an operator, below which at least one heating unit is arranged in particular in an operating state.

The cooking system 10*a* comprises the placement unit 16*a*. The placement unit 16*a* is provided for placing on the cooking surface 18*a* for the purpose of a heating operation for the placement unit 16*a*.

The cooking system 10*a* has at least one heating unit (not shown). In the present exemplary embodiment the cooking system 10*a* has a plurality of heating units. Alternatively for example the cooking system 10*a* could have a smaller number of heating units, for example just one heating unit and/or at least two, in particular at least four, advantageously at least eight, particularly advantageously at least twelve and preferably multiple heating units. The heating units could be arranged for example in the form of a matrix. Only one of the heating units is described in the following.

In an installed position the heating unit is arranged below the placement plate 28*a*. The heating unit is provided to heat at least one placement unit 16*a* placed on the placement plate 28 above the heating unit. The heating unit is configured as an induction heating unit. In the operating state the heating unit is arranged below the cooking surface 18*a*.

The cooking system 10*a* has an operator interface 12*a*. The operator interface 12*a* is provided for the inputting and/or selection of operating parameters, such as a heating power and/or a heating power density and/or a heating zone. The operator interface 12*a* is provided for the outputting of a value of an operating parameter to an operator.

In addition to the inputting and/or selection of operating parameters, the operator interface 12*a* is provided in particular for the inputting of an identification characteristic. For example, at least one identification characteristic could be a fingerprint and/or facial recognition and/or speech recognition. In the present exemplary embodiment at least one identification characteristic is a password, in particular a password that can be input manually.

In the present exemplary embodiment the operator interface 12*a* is configured as a cooktop operator interface. The operator interface 12*a* is largely integrated in an operator interface 38*a* of the cooktop 24*a*. In the present exemplary embodiment the operator interface 12*a* forms an operator interface 38*a* of the cooktop 24*a*. In the present exemplary embodiment the operator interface 12*a* of the cooking system 10*a* is part of the cooktop 24*a*. The cooktop 24*a* comprises the operator interface 12*a* of the cooking system 10*a*.

In an alternative exemplary embodiment the operator interface 12*a* could in particular be configured as a mobile device operator interface. In particular the operator interface 12*a* could be largely integrated in a mobile device (not shown).

The cooking system 10*a* has a control unit 14*a*. In the operating state the control unit 14*a* controls and/or regulates a main cooktop function. The control unit 14*a* is provided to execute actions and/or change settings as a function of operating parameters input by way of the operator interface 12*a*. The control unit 14*a* regulates an energy supply to the heating unit in the operating state.

In the present exemplary embodiment the control unit 14*a* is configured as a cooktop control unit. The control unit 14*a* is largely integrated in a control unit 40*a* of the cooktop 24*a*. In the present exemplary embodiment the control unit 14*a* forms a control unit 40*a* of the cooktop 24*a*. The control unit 14*a* of the cooking system 10*a* is part of the cooktop 24*a*. The cooktop 24*a* comprises the control unit 14*a* of the cooking system 10*a*.

The control unit 14*a* has a control unit interface 26*a* for communication with the operator interface 12*a*. The control unit 14*a* is provided to communicate with the operator interface 12*a* by way of the control unit interface 26*a*.

For example, the control unit 14*a* could be provided to communicate wirelessly with the operator interface 12*a*, in particular with at least one communication interface 42*a* of the operator interface 12*a*, by way of the control unit interface 26*a*. Alternatively or additionally the control unit 14*a* could be provided to communicate in a wired manner with the operator interface 12*a*, in particular with at least one communication interface 42*a* of the operator interface 12*a*, by way of the control unit interface 26*a*.

The operator interface 12*a* has at least one communication interface 42*a*. The operator interface 12*a* is provided to communicate with the control unit 14*a*, in particular with the control unit interface 26*a* of the control unit 14*a*, by way of the communication interface 42*a*.

In the operating state the control unit 14*a* releases at least one cooking function for the placement unit 16*a* as a function of the identification characteristic, input by way of the operator interface 12*a*, for the placement unit 16*a* provided to be placed on the cooking surface 18*a* for the purpose of a heating operation for the placement unit 18*a*. Alternatively or additionally in the operating state the control unit 14*a* blocks at least one cooking function for the placement unit 16*a* as a function of the identification characteristic, input by way of the operator interface 12*a*, for the placement unit 16*a* provided to be placed on the cooking surface 18*a* for the purpose of a heating operation for the placement unit 18*a*.

The control unit 14*a* comprises the storage unit 22*a*. A reference characteristic for the identification characteristic is stored in the storage unit 22*a*. The control unit 14*a* compares an input identification characteristic with the reference characteristic for the identification characteristic. In the operating state the control unit 14*a* blocks the cooking function or in the operating state the control unit 14*a* releases the cooking function as a function of the correspondence between the input identification characteristic and the reference characteristic for the identification characteristic.

The cooking system 10*a* has a detection unit 20*a* to identify the placement unit 16*a*. In the present exemplary embodiment the detection unit 20*a* is configured partially as a single piece with the heating unit. In an installed position the detection unit 20*a* is arranged largely below the placement plate 28*a*.

The detection unit 20*a* is provided to detect at least one placement unit characteristic of the placement unit 16*a*. In the present exemplary embodiment the detection unit 20*a* detects the placement unit characteristic of the placement unit 16*a* in the operating state, in particular inductively and/or by means of an inductive coupling between the heating unit and the placement unit 16*a*.

Alternatively or additionally the detection unit 20*a* could in particular have a receive unit (not shown), which could be provided to receive the placement unit characteristic. The receive unit could be provided for example to receive the placement unit characteristic from the operator interface 12*a* and/or from a further unit and/or from a mobile device and/or from a network.

In the operating state the control unit 14*a* blocks a heating operation for the placement unit 16*a* as a function of a detected placement unit characteristic of the placement unit 16*a*, in particular in at least one cooking function. In the operating state, in particular in at least one cooking function, the control unit 14*a* releases a heating operation for the placement unit 16*a* as a function of a detected placement unit characteristic of the placement unit 16*a*.

A reference characteristic for the placement unit characteristic is stored in the storage unit 22*a*. The control unit 14*a* compares a detected placement unit characteristic with the reference characteristic for the placement unit characteristic. In the operating state the control unit 14*a* assigns an identity to the placement unit 16*a* as a function of the correspondence between the detected placement unit characteristic and the reference characteristic for the placement unit characteristic. In the operating state the control unit 14*a* assigns an identity to the placement unit 16*a* by comparing the reference characteristic with the detected placement unit characteristic.

If the detected placement unit characteristic corresponds to the reference characteristic for the placement unit characteristic, the control unit 14*a* assigns an identity described as "known" to a placement unit 16*a*. If the detected placement unit characteristic differs from the reference characteristic for the placement unit characteristic in at least one feature, the control unit 14*a* assigns an identity described as "unknown" to a placement unit 16*a*.

A cooking function is a safe operating state. In the safe operating state the control unit 14*a* releases a heating operation for at least one known placement unit 16*a*. In the safe operating state the control unit 14*a* blocks a heating operation for at least one unknown placement unit 16*a*.

The safe operating state is preset. The cooking function that is a safe operating state is preset. When the control unit 14*a* is started up and/or activated, the control unit 14*a* automatically starts the safe operating state and/or the cooking function that is a safe operating state.

A cooking function is a normal operating state. In the normal operating state the control unit 14*a* releases a heating operation for at least one placement unit 16*a* regardless of an identity of the placement unit 16*a*. In the normal operating state the control unit 14*a* refrains from blocking a heating operation for the placement unit 16*a*, in particular regardless of an identity of the placement unit 16*a*.

A cooking function is an automatic cooking program. The control unit 14*a* releases the cooking function that is an automatic cooking function as a function of an inputting of the identification characteristic and/or as a function of the detected placement unit characteristic. Alternatively or additionally the control unit 14*a* blocks the cooking function that is an automatic cooking function as a function of an inputting of the identification characteristic and/or as a function of the detected placement unit characteristic.

The control unit 14*a* switches between at least two cooking functions as a function of an inputting of the identification characteristic. For example, the control unit 14*a* could switch from the cooking function that is a safe operating state to the cooking function that is a normal operating state as a function of an inputting of the identification characteristic. The control unit 14*a* could for example switch from the cooking function that is a normal operating state to the cooking function that is a safe operating state as a function of an inputting of the identification characteristic.

In a method for operating the cooking system 10*a* a cooking function is released and/or blocked for the placement unit 16*a* as a function of at least one identification characteristic for at least one placement unit 16*a* input by way of the operator interface 12*a*. In an activation step 30*a* the control unit 14*a* and in particular the cooktop 24*a* are started (see FIG. 2). The control unit 14*a* activates and/or starts a cooking function that is a safe operating state as a function of an activation of the control unit 14*a* and in particular of the cooktop 24*a*.

In an input step 32*a* an identification characteristic for the placement unit 16*a* is input, in particular by way of the operator interface 12*a*. The control unit 14*a* switches between two cooking functions, in particular between the cooking function that is a safe operating state and the cooking function that is a normal operating state, as a function of an identification characteristic for the placement unit 16*a* input in particular by way of the operator interface 12*a*.

In a further input step 34*a* an identification characteristic for the placement unit 16*a* is input, in particular by way of the operator interface 12*a*. In the further input step 34*a* the control unit 14*a* switches between two cooking functions, in particular between the cooking function that is a normal operating state and the cooking function that is a safe operating state, as a function of an identification characteristic for the placement unit 16*a* input in particular by way of the operator interface 12*a*.

Figure 2:
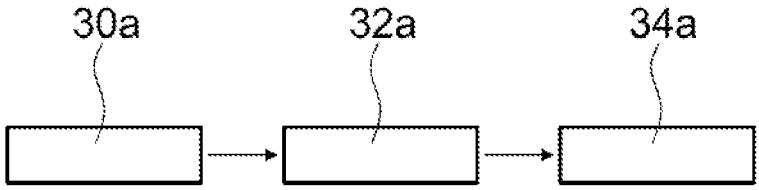
FIG. 2 shows a schematic diagram of a method for operating the cooking system and FIG. 3 shows a schematic, highly simplified top view of an alternative cooking system with an alternative cooktop.
Figure 3:
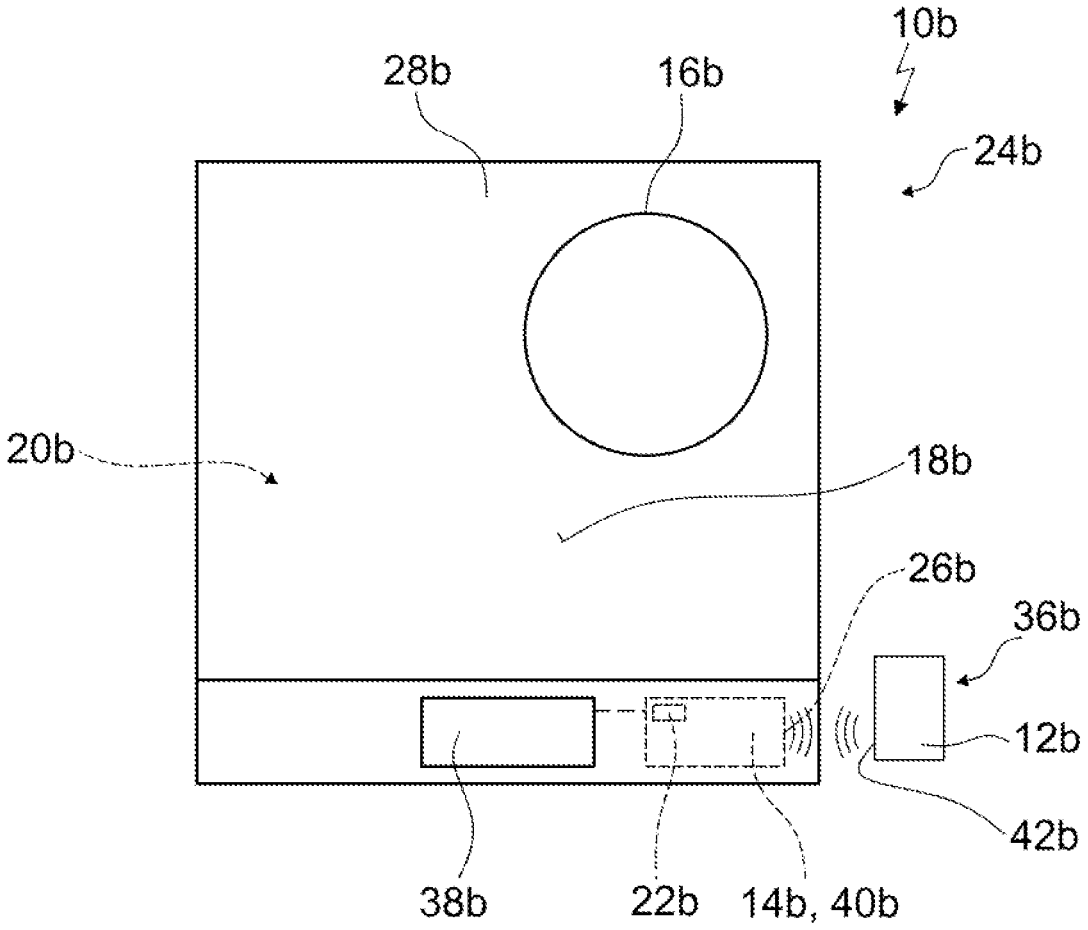

FIG. 3 shows a further exemplary embodiment of the invention. The descriptions that follow are limited essentially to differences between the exemplary embodiments, it being possible to refer to the description of the exemplary embodiment in FIGS. 1 and 2 for parts, features and functions that remain the same. To distinguish between the exemplary embodiments, the letter a in the reference characters for the exemplary embodiment in FIGS. 1 and 2 is replaced by the letter b in the reference characters for the exemplary embodiment in FIG. 3. Reference can in principle also be made to the drawings and/or description of the exemplary embodiment in FIGS. 1 and 2 for parts that are designed in the same manner, in particular for parts with the same reference characters.

FIG. 3 shows an alternative cooking system 10*b* with an alternative cooktop 24*b*. The cooking system 10*b* has a control unit 14*b*. The control unit 14*b* is configured as a cooktop control unit. The control unit 14*b* is largely integrated in the cooktop 24*b*.

The cooking system 10*b* has an operator interface 12*b*. In the present exemplary embodiment the operator interface 12*b* is configured as a mobile device operator interface. The operator interface 12*b* is largely integrated in a mobile device 36*b*. The cooking system 10*b* comprises the mobile device 36*b*.

In the present exemplary embodiment the mobile device 36*b* is a cellphone. Alternatively or additionally the mobile device 36*b* could be a laptop and/or tablet for example.

The invention claimed is:

1. A cooking system, comprising:

an operator interface configured to enable input of an identification characteristic for a placement unit configured to be placed on a cooking surface for purpose of a heating operation;

a control unit configured to release or block a cooking function for the placement unit as a function of the identification characteristic input via the operator interface; and a detection unit configured to detect a placement unit characteristic of the placement unit, wherein the detection unit is operably connected to the control unit such that the control unit releases or blocks the heating operation for the placement unit as a function of the placement unit characteristic detected;

wherein the control unit, depending on the identification characteristic input, switches the cooking function between at least a safe operating state and a normal operating state;

wherein when the released cooking function is the normal operating state, the control unit is configured to release the heating operation for the placement unit regardless of the detected placement unit characteristic; and wherein when the released cooking function is the safe operating state, the control unit is configured to analyze the detected placement unit characteristic and release the heating operation for a known placement unit, while blocking the heating operation for an unknown placement unit.

2. The cooking system of claim 1, constructed in the form of an induction cooking system.

3. The cooking system of claim 1, wherein the control unit includes a storage unit for storing a reference characteristic for the placement unit characteristic in an operating state, said control unit being configured to assign an identity to the placement unit by comparing the reference characteristic with the detected placement unit characteristic.

4. The cooking system of claim 3, wherein based on the assigned identity, the control unit is configured to release the heating operation for the placement unit, when identified as known, while blocking the heating operation for another unknown placement unit, when the cooking function is the safe operating state.

5. The cooking system of claim 4, wherein the safe operating state is preset.

6. The cooking system of claim 1, wherein the cooking function is an automatic cooking program.

7. The cooking system of claim 1, wherein the identification characteristic is a password.

8. The cooking system of claim 1, wherein the control unit is configured as a cooktop control unit.

9. The cooking system of claim 1, wherein the operator interface is configured as a cooktop operator interface.

10. A cooktop, comprising:

A control unit forming part of a cooking system which includes an operator interface for input of an identification characteristic for a placement unit heatable on a cooking surface, wherein the control unit is configured to release or block a cooking function for the placement unit as a function of the identification characteristic input via the operator interface;

wherein the control unit includes a control unit interface configured to communicate with the operator interface; and a detection unit configured to detect a placement unit characteristic of the placement unit, wherein the detection unit is operably connected to the control unit such that the control unit releases or blocks a heating operation for the placement unit as a function of the placement unit characteristic detected;

wherein the control unit, depending on the identification characteristic input, switches the cooking function between at least a safe operating state and a normal operating state; and wherein when the released cooking function is the safe operating state, the control unit is configured to analyze the detected placement unit characteristic and release the heating operation for a known placement unit, while blocking the heating operation for an unknown placement unit.

11. The cooktop of claim 10, wherein the control unit includes a storage unit for storing a reference characteristic for a placement unit characteristic in an operating state, said control unit being configured to assign an identity to the placement unit by comparing the reference characteristic with a detected placement unit characteristic.

12. The cooking system of claim 11, wherein the control unit is configured to release the heating operation for the placement unit regardless of the placement unit characteristic, when the cooking function is the normal operating state.

13. The cooktop of claim 10, wherein the control unit is configured as a cooktop control unit.

14. A method for operating a cooking system, said method comprising:

inputting via an operator interface an identification characteristic for a placement unit placeable on a cooking surface for purpose of a heating operation;

releasing or blocking a cooking function of the placement unit as a function of the identification characteristic;

depending on the identification characteristic inputted, switching the cooking function between at least a safe operating state and a normal operating state;

detecting a placement unit characteristic of the placement unit; and releasing or blocking the heating operation for the placement unit as a function of the placement unit characteristic detected.

15. The method of claim 14, further comprising:

storing a reference characteristic for the placement unit characteristic in an operating state, and assigning an identity to the placement unit by comparing the reference characteristic with the detected placement unit characteristic.

16. The method of claim 15, wherein the cooking function is the safe operating state, in which the heating operation is released for the placement unit, when identified as known, while blocking the heating operation for another unknown placement unit.

17. The method of claim 14, further comprising presetting the safe operating state.

18. The method of claim 14, wherein the cooking function is the normal operating state, in which the heating operation is released for the placement unit regardless of the placement unit characteristic.

19. The method of claim 14, wherein the cooking function is an automatic cooking program.

20. The method of claim 14, wherein the identification characteristic is a password.

* * * * *